United States Patent [19]

Ogawa

[11] 4,374,711

[45] Feb. 22, 1983

[54] PROCESS FOR THE ELECTROLYSIS OF AN AQUEOUS SODIUM CHLORIDE SOLUTION COMPRISING, IN COMBINATION, A DIAPHRAGM PROCESS AND A CATION EXCHANGE MEMBRANE PROCESS

[75] Inventor: Shinsaku Ogawa, Nobeoka, Japan

[73] Assignee: Asahi Kasei Kogyo Kabushiki Kaisha, Osaka, Japan

[21] Appl. No.: 229,842

[22] Filed: Jan. 30, 1981

[30] Foreign Application Priority Data

Jan. 30, 1980 [JP] Japan ..... 55-8715

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,321,388 | 5/1967 | Ueda et al. | 204/129 |
| 3,897,320 | 7/1975 | Cook | 204/128 |
| 4,100,050 | 7/1978 | Cook et al. | 204/98 |
| 4,147,600 | 4/1979 | Rutherford et al. | 204/128 |

*Primary Examiner*—R. L. Andrews

*Attorney, Agent, or Firm*—Birch, Stewart, Kolasch & Birch

[57] ABSTRACT

In a process for the electrolysis of an aqueous sodium chloride solution comprising, in combination, a diaphragm process and a cation exchange membrane process, the sodium chloride obtained from the diaphragm process is dissolved in the weak saline solution obtained from the cation exchange membrane process to obtain a saline solution, which, in turn, is supplied to the anode chamber of the diaphragm process. By the present process, there can be obtained sodium hydroxide of which the impurities content is extremely low, with high efficiency.

6 Claims, 1 Drawing Figure

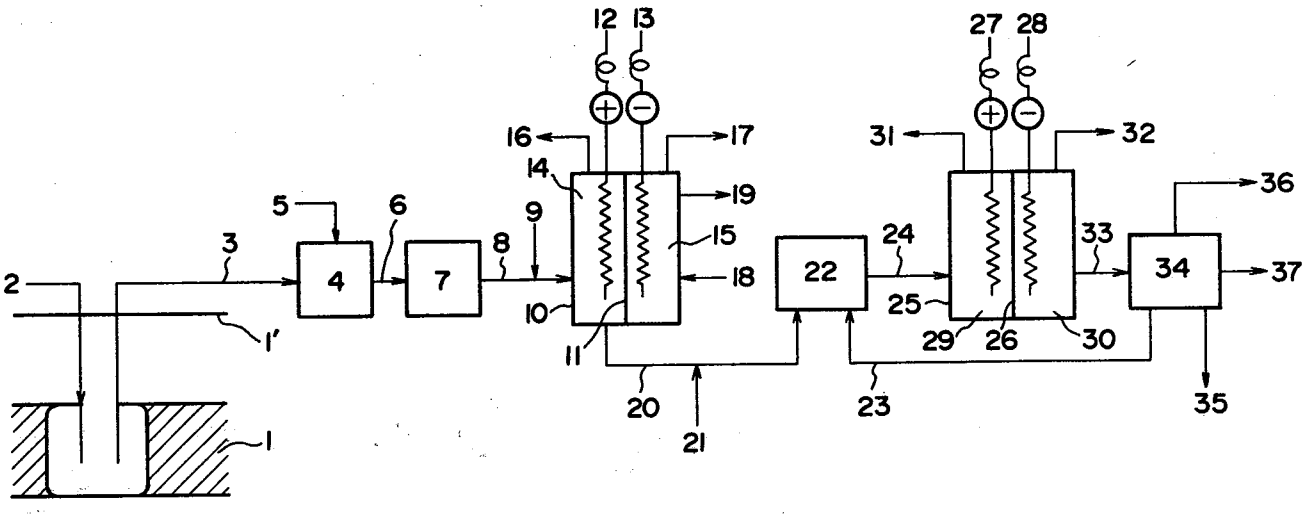
36
37
35
34
32
33
30
28
27
26
29
31
24
25
23
22
17
19
15
18
21
13
12
20
11
16
14
9
10
8
7
6
4
5
3
1'
1
2

PROCESS FOR THE ELECTROLYSIS OF AN AQUEOUS SODIUM CHLORIDE SOLUTION COMPRISING, IN COMBINATION, A DIAPHRAGM PROCESS AND A CATION EXCHANGE MEMBRANE PROCESS

This invention relates to a process for the electrolysis of an aqueous sodium chloride solution to produce chlorine, hydrogen and sodium hydroxide. More particularly, the present invention is concerned with a process for the electrolysis of an aqueous sodium chloride solution, which comprises, in combination, a diaphragm process in which sodium chloride as an impurity is crystallization-separated from the catholyte by means of a crystallizer used in the diaphragm process and a cation exchange membrane process in which a weak saline solution is taken out of the anode chamber of the electrolytic cell, characterized in that the sodium chloride separated in the crystallizer is dissolved in the weak saline solution taken out of the anode chamber in the cation exchange membrane process and the resulting saline solution is supplied into the anode chamber of the electrolytic cell for the diaphragm process.

Conventionally, a cation exchange membrane process and a diaphragm process are well known to electrolyze an aqueous sodium chloride solution (hereinafter often referred to as "saline solution") for the production of chlorine, hydrogen and sodium hydroxide. A diaphragm process has a long history as compared with a cation exchange membrane process, and there are many factories in which the diaphragm process is carried out. Recently, for the reason that as compared with a diaphragm process, a cation exchange membrane process has such various advantages that the total energy consumption is small, that the quality of the desired product is high, that it is easy to operate, that it is easy to vary a load and that stepwise increase of apparatus for the process is easy, it attracts attention in the art to build a cation exchange membrane process factory beside a diaphragm process factory in combination so that advantages of combination of both the processes may be enjoyed.

With respect to realization of such combination, various processes have heretofore been proposed. For example, there has been proposed a process in which the catholyte obtained in a diaphragm process is supplied into the cathode chamber of an electrolytic cell for a cation exchange membrane process (see U.S. Pat. No. 4,147,600). This proposed process, however, has disadvantages as follows. In this process, the diaphragm process-produced sodium hydroxide containing a large amount of sodium chloride is supplied into the cathode chamber of a cation exchange membrane process and, hence, the catholyte obtained in the cation exchange membrane process is caused to contain a large amount of sodium chloride. Accordingly, such a great advantage of a cation exchange membrane process that high purity sodium hydroxide can be obtained will be lost. Further, since sodium chloride has poor electric conductivity as compared with sodium hydroxide, the electric power cost of such a cation exchange membrane process as combined with a diaphragm process in the above-mentioned manner will be high.

In Japanese Patent Applications Laid-Open Specifications Nos. 67,697/1978, 149,196/1978 and 149,197/1978, it is disclosed to dissolve, in water and/or the weak saline solution from a cation exchange membrane process, the sodium chloride obtained from a crystallizer used in a diaphragm process and the resulting saline solution is supplied into the anode chamber of an electrolytic cell for a cation exchange membrane process. However, in the sodium chloride crystallization-separated in the concentration step of a diaphragm process, there are inevitably contained not only silica and alumina which are introduced from the asbestos used in diaphragm process and are difficult to remove even by the use of a chelating ion exchange resin, but also heavy metals which are introduced due to corrosion of the crystallizer because the sodium hydroxide obtained by the diaphragm process inherently contains large amounts of sodium chloride and sodium chlorate which are highly corrosive. When the above-mentioned silica, alumina and heavy metals are supplied, together with the sodium chloride, into the anode chamber of the electrolytic cell for a cation exchange membrane process, they are deposited on and/or in the cation exchange membrane, causing not only the electrolytic voltage to be extremely elevated but also the membrane itself to be destroyed occasionally.

In Japanese Patent Application Laid-Open Specification No. 67696/1978, it is disclosed that sodium chloride is dissolved in the weak saline solution taken out of the anode chamber of an electrolytic cell for a cation exchange membrane process and the resulting saline solution is supplied into a diaphragm process so that the sodium chlorate formed in the cation exchange membrane process is prevented from being accumulated in the anode chamber of the electrolytic cell for the cation exchange membrane process. In this case, however, all the sodium chlorate formed in the cation exchange membrane process is supplied into the diaphragm process and then introduced, through the diaphragm, into the sodium hydroxide produced by the diaphragm process. In the diaphragm process, the sodium chlorate content of the sodium hydroxide produced is inherently high and, hence, there have heretofore been many problems with respect to corrosion of the crystallizer as well as the use of the product. Therefore, further incorporation into the product of the sodium chlorate formed in the cation exchange membrane is apparently unfavorable.

Accordingly, it is one and a principal object of the present invention to provide a process for the electrolysis of an aqueous sodium chloride solution comprising, in combination, a diaphragm process and a cation exchange membrane process, which realizes the most effective combination of both the processes to produce high purity sodium hydroxide with high efficiency.

The foregoing and other objects, features and advantages of the present invention will be apparent to those skilled in the art from the following detailed description taken in connection with the accompanying drawing in which:

FIGURE is a flow sheet illustrating one mode of the process of the present invention.

According to the present invention, there is provided a process for the electrolysis of an aqueous sodium chloride solution comprising, in combination, a diaphragm process in which sodium chloride contained in the catholyte is crystallization-separated by means of a crystallizer used in the diaphragm process and a cation exchange membrane process in which a weak saline solution is taken out of an anode chamber of an electrolytic cell for the cation exchange membrane process, characterized in that the sodium chloride obtained from said crystallizer is dissolved in the weak saline solution taken out of said anode chamber and the resulting saline solution is supplied into an anode chamber of an electrolytic cell for the diaphragm process.

Naturally, as the sodium chloride to be dissolved in the weak saline solution obtained from the cation exchange membrane process, there may be thought of use of various kinds of salts, such as sun-dried salt, salt obtained by the concentration of brine in an evaporator, etc. However, it should be noted that only by the use of the sodium chloride or salt obtained from the crystallizer used in a diaphragm process, the special effect of the present invention can be achieved. When sun-dried salt or salt obtained by the concentration of brine in an evaporator is dissolved in the weak saline solution obtained from the cation exchange membrane process to obtain a saline solution, it is preferred that the saline solution thus obtained be supplied into an anode chamber of an electrolytic cell for the cation exchange membrane process. In this case, even when a diaphragm process factory and a cation exchange membrane process factory are built in combination, they are independently operated with advantage. In such independent operation of both the process factories, even if sodium chlorate is formed in the anolyte of the cation exchange membrane process, it is preferred that the sodium chlorate be accumulated to a sufficiently high concentration and then, part of the weak saline solution from the anode chamber of the electrolytic cell for the cation exchange membrane process be discarded. As described in connection with Japanese Patent Application Laid-Open Specification No. 67696/1978, the saline solution obtained by dissolving sun-dried salt or salt obtained by the concentration of brine in an evaporator in the weak saline solution from the cation exchange membrane process must not be supplied into the anode chamber of the electrolytic cell for the diaphragm process, in order to avoid increase in concentration of sodium chlorate in the sodium hydroxide produced by the diaphragm process.

A saline solution to be supplied into an anode chamber of the cation exchange membrane process usually contains sulfate groups. When the cation exchange membrane process is carried out independently, the sulfate groups are accumulated and therefore, the accumulated sulfate groups are necessarily removed. However, according to the process of the present invention, all the sulfate groups in the saline solution supplied into the anode chamber of the cation exchange membrane process are consequently supplied into the anode chamber of the diaphragm process and, in turn, move into the catholyte of the diaphragm process through the diaphragm. The catholyte is then concentrated, and the sulfate groups in the catholyte are removed as sodium sulfate by an ordinary method. Accordingly, according to the process of the present invention, the step for removing the sulfate groups in the cation exchange membrane process is no longer needed, as opposed to the case in which a cation exchange membrane process and a diaphragm process are carried out independently.

Generally stated, a saline solution to be used in the cation exchange membrane process is purified to an extreme high degree as compared with that to be used in the diaphragm process. Illustratively stated, if the saline solution contains, as impurities, cations of high valency capable of precipitating as hydroxides, they are caused to precipitate on and/or in the cation exchange membrane, causing not only the electrolytic voltage to be elevated, but also the membrane to be destroyed in an extreme case. For this reason, with respect to a saline solution to be used in the cation exchange membrane process, in addition to an ordinary purification in which sodium hydroxide, sodium carbonate, calcium chloride, barium carbonate and the like are added to the saline solution, there is industrially adopted a secondary purification in which the saline solution is treated with a chelating ion exchange resin or phosphoric acid is added to the saline solution, in order to effect a further purification of the saline solution. In case a saline solution which has been subjected to the above-mentioned secondary purification in addition to the ordinary purification is used in the cation exchange membrane process and the weak saline solution from the cation exchange membrane process is used for preparing a saline solution to be supplied into an anode chamber of the diaphragm process by dissolving therein the sodium chloride from the crystallizer of the diaphragm process, impurities such as calcium ions, magnesium ions and the like are no longer introduced into the system of diaphragm process.

Conventionally, in a diaphragm process, there is used a saline solution which has been subjected to only the ordinary purification. Therefore, when the operation of the diaphragm process is carried for a long period of time, the hydroxides tend to be consecutively deposited in the diaphragm, causing not only the current efficiency to be lowered and the electrolytic voltage to be elevated, but also the movement of the liquid from the anode chamber to cathode chamber to be difficult. For this reason, in the diaphragm process, there is such a great disadvantage that the diaphragm usually needs to be renewed every year. In contrast, according to the process of the present invention, the above-mentioned great disadvantage can be completely eliminated.

For the secondary purification of a saline solution, there may be employed a method in which phosphoric acid is added to a saline solution. According to this method, however, a minute amount of phosphate and excess phosphoric acid are unavoidably contained in the weak saline solution. When a saline solution prepared by dissolving the sodium chloride from the crystallizer of the diaphragm process in the above-mentioned weak saline solution is supplied into an anode chamber of the diaphragm process, not only is there a fear of deposition of the phosphate in the diaphragm, but also the phosphoric acid tends to be incorporated into the sodium hydroxide obtained by the diaphragm, causing the quality of the product to be lowered. Therefore, the treatment of a saline solution with a chelating ion exchange resin may preferably be employed for the secondary purification of a saline solution. The term "chelating ion exchange resin" used herein is intended to include ion exchange resins having as the ion exchange group an iminodiacetic acid group or the like.

With respect to sodium chloride or salt as the raw material, taking as an example a rock salt, an explanation will be given. In the case of rock salt, water is introduced into an underground rock salt layer and the resulting saturated saline solution is transported to a factory by means of a pipe. In case the cation exchange membrane process factory alone is built, if the factory is located at such a relatively small distance from the rock salt layer that the weak saline solution obtained from the cation exchange membrane process can be easily introduced into the underground rock salt layer, there is no problem. However, in the above-mentioned case, if the distance between the factory and the rock salt layer is as large as 10 to 50 km, the cost of building pipes for introducing the weak saline solution to and returning the saline solution from the rock salt layer and the power cost therefor are very high and uneconomical. In the latter, additional building of an apparatus for concentrating the weak saline solution obtained from the cation exchange membrane process is rather economical. In this case, however, even by simply building a cation exchange membrane process factory and a diaphragm process factory in combination and operating them independently, an apparatus for concentrating the weak saline solution obtained from the cation exchange membrane process need not be additionally built. Illustratively stated, the catholyte obtained by the diaphragm process usually contains about 11% of sodium hydroxide and about 17% of sodium chloride. The catholyte is then concentrated so that the concentration of sodium hydroxide is about 50% and the concentration of sodium chloride is about 1%, and, at the same time, sodium chloride is deposited. To the deposited sodium chloride is added water to dissolve the sodium chloride in water. The resulting saline solution is supplied into the anode chamber of the diaphragm process.

As opposed to the above, according to the process of the present invention, to dissolve the salt obtained from the crystallizer of the diaphragm process, the weak saline solution obtained from the cation exchange membrane process is used in place of water which is conventionally used in the diaphragm process. Therefore, as opposed to the case in which the cation exchange membrane process factory alone is built, according to the present invention, an apparatus for concentrating the weak saline solution is no longer needed.

As described before, in practicing the process of the present invention, it is not advantageous that the sodium chlorate formed in the cation exchange membrane process is supplied into the anode chamber of the diaphragm process. Therefore, in practice of the present invention, it is preferred to prevent formation of sodium chlorate in the cation exchange membrane process. It is preferred that the concentration of sodium chlorate in the weak saline solution be not more than 500 ppm, more preferably not more than 100 ppm. On the other hand, with respect to prevention of the formation of sodium chlorate, the present inventors have made extensive researches. As a result, it has been found that by satisfying at least one of the undermentioned conditions (1) to (4), formation of sodium chlorate in the cation exchange membrane process is prevented or reduced to a level lower than that in the diaphragm process.

(1) It is preferred to use a cation exchange membrane having a current efficiency of 90% or more. Usually, the diaphragm process is operated at a current currency of 90 to 96%. Cation exchange membranes include those having, for example, a sulfonic acid group, a sulfonamide group and/or a carboxylic acid group. Of the above-mentioned cation exchange membranes, those having a sulfonic acid group are strongly acidic and therefore hydrophilic. For this reason, they do not provide high current efficiency. At a practical sodium hydroxide concentration of 15% or more, they provide a current efficiency of only not more than 80%. The cation exchange membranes having a sulfonamide group or a carboxylic acid group can maintain a current efficiency at 90% or more. However, the sulfonamide group is readily hydrolyzed and therefore, from a viewpoint of chemical stability of the cation exchange group, it is preferred to use cation exchange membranes having a carboxylic acid group. Further, from a viewpoint of corrosion-resistance to chlorine gas, it is preferred the skeletal structure of polymer of a cation exchange membrane be of a perfluorocarbon type. Consequently, it is advantageous to use a perfluorocarboxylic acid type cation exchange membrane.

(2) It is preferred that the concentration of sulfate groups in a saline solution to be supplied into the anode chamber of the cation exchange membrane process be maintained at a level as high as possible. In other words, it is preferred that the saline solution to be supplied into the anode chamber of the cation exchange membrane process not be subjected to a sulfate groups-removing treatment, such as addition of calcium chloride, barium chloride, barium carbonate and the like. The preferred concentration of sulfate groups in the saline solution to be supplied into the anode chamber is 5 g/liter to 30 g/liter.

(3) It is preferred that the concentration of sodium chloride in the weak saline solution from the cation exchange membrane process be maintained at a level as low as possible. The preferred concentration of sodium chloride in the weak saline solution is 100 g/liter to 200 g/liter.

(4) It is preferred that the pH value of the weak saline solution from the cation exchange membrane process be maintained at not more than 3.5. For attaining such a pH value, it is preferable that an acid such as hydrochloric acid is added to a line of saline solution before the line of saline solution enters the anode chamber of the cation exchange membrane process or after the line of saline solution leaves the anode chamber. Most preferably, an acid is added before the line of saline solution enters the anode chamber of the cation exchange membrane process. In this case, if a carboxylic acid type membrane or a sulfonamide type membrane is used as the cation exchange membrane, the exchange group is converted to an acid type group when the pH value in the anode chamber is lowered, thereby often causing the electric conductivity of the cation exchange membrane to be lost. For this reason, it is preferred that a cation exchange membrane having a carboxylic acid group and a sulfonic acid group co-present therein or a cation exchange membrane having a sulfonamide group and a sulfonic acid group co-present therein be used and that the cation exchange membrane be disposed in the electrolytic cell in such a manner that the sulfonic acid layer is on the side of the anode and the carboxylic acid layer or sulfonamide layer is on the side of the cathode.

The present invention will now be illustrated in more detail with reference to Examples taken in connection with the accompanying drawing. The sole FIGURE of the drawing is a flow sheet illustrating one mode of the process of the present invention. The Examples and the FIGURE, however, should not be construed to limit the scope of the present invention.

In the FIGURE, numeral 1 designates an underground rock salt layer, numeral 1' a ground surface, numeral 2 water and/or the weak saline solution from a cation exchange membrane process for dissolving therein an underground rock salt, numeral 3 a saturated saline solution, and numeral 4 an ordinary saline solution-purifying process. In the saline solution-purifying process 4, sodium hydroxide, sodium carbonate and the like are added to the saline solution from sources 5, so that magnesium, calcium and the like are precipitated as hydroxides and carbonates thereof and then separated by filtration. In this purifying process, from a economical point of view, the saline solution is purified to an extent that the concentration of calcium is about 10 to 3 ppm. The saline solution 6 which has been subjected to the primary purification at 4 is further purified at a secondary purifying process 7 where the saline solution is treated with a chelating exchange resin or phosphoric acid is added to the saline solution. To the saline solution 8 which has been subjected to the secondary purification at 7, an acid 9 is added to adjust the pH value of a weak saline solution 20 from a cation exchange membrane process. Occasionally, addition of the acid 9 may be omitted. Numeral 10 designates an electrolytic cell for the cation exchange membrane process, numeral 11 a cation exchange membrane, numeral 12 an anode, numeral 13 a cathode, numeral 14 an anode chamber, numeral 15 a cathode chamber, numeral 16 chlorine gas, and numeral 17 hydrogen gas. In order to lower the electrolytic voltage, water is added from 18. Occasionally, addition of water may be omitted. Numeral 19 designates an aqueous sodium hydroxide solution produced in the cation exchange membrane process and numeral 20 designates a weak saline solution obtained from the cation exchange membrane process. In order to adjust the pH value of the weak saline solution 20, an acid 21 may be added to the weak saline solution 20. Occasionally, addition of the acid 21 may be omitted. Numeral 22 designates a sodium chloride-dissolving vessel, numeral 23 a crystallized salt or sodium chloride obtained from a crystallizer 34 of a diaphragm process, numeral 24 a saline solution obtained by dissolving the crystallized salt 23 in the weak saline solution, numeral 25 an electrolytic cell for the diaphragm process, numeral 26 a diaphragm made mainly of asbestos, numeral 27 an anode, numeral 28 a cathode, numeral 29 an anode chamber, numeral 30 a cathode chamber, numeral 31 chlorine gas, numeral 32 hydrogen gas, and numeral 33 a catholyte. As a crystallizer 34 of the diaphragm process, there is usually used a triple effect evaporator or a quadruple effect evaporator. After crystallization, the crystallized salt is separated by centrifugation. In this instance, simultaneously with washing of the crystallized salt, removal of sodium sulfate 35 is attained. Numeral 36 designates evaporated water and numeral 37 designates a separated mother liquor, namely, sodium hydroxide produced by the diaphragm process.

EXAMPLE 1

In the flow sheet of the FIGURE, water 2 was introduced into an underground rock salt layer 1 to obtain a saturated saline solution 3. The concentration of sulfate groups in the saturated saline solution thus obtained was 7 g/liter. Sodium hydroxide and sodium carbonate was added, through a line 5, to the saturated saline solution in a primary purifying process 4, in which the saline solution was subjected to the treatments in a precipitating vessel and a filter. As a result, there was obtained a saturated saline solution having a calcium ion concentration of 7 ppm, a magnesium ion concentration of 0.5 ppm, a sulfate ion concentration of 7 g/liter and a pH value of 9.5. The saturated saline solution was further passed through an iminodiacetic acid type chelating ion exchange column at 7 to obtain a further purified saturated saline solution 8 having a concentration of not more than 0.1 ppm with respect to each of calcium ion and magnesium ion. To the saturated saline solution 8 thus obtained was added hydrochloric acid through a line 9 so that the pH value of a weak saline solution became 2.8.

As a cation exchange membrane 11, there was employed a membrane having a perfluorocarboxylic acid group layer on the side of a cathode and a perfluorosulfonic acid group layer on the side of an anode. The current efficiency of the membrane was 96%.

In order to lower the electrolytic voltage, pure water was added through a line 18 so that the concentration of sodium hydroxide in a catholyte was maintained at 21% by weight. In the catholyte, the sodium chloride concentration was about 20 ppm and the sulfate ion concentration was less than 10 ppm, namely less than the detectable limit. The temperature of electrolysis was 90° C., the current density was 40 A/dm$^2$ and the concentration of sodium chloride in the weak saline solution was 150 g/liter.

In the cation exchange membrane process, during the time when sodium ions moved from the anode chamber to the cathode chamber by electrophoresis, water accompanied the sodium ions. For this reason, the sulfate ion concentration in the weak saline solution was increased to about 10 g/liter. The sodium chlorate concentration in the weak saline solution was less than 100 ppm, namely, less than the detectable limit in the analysis of sodium chlorate by the so-called Hooker's method.

Without addition of an acid from 21, the weak saline solution was introduced to a salt-dissolving vessel 22, in which crystallized salt from a crystallizer 34 (triple effect evaporator) of a diaphragm process was dissolved in the weak saline solution to obtain a saturated saline solution 24. The saline solution 24 was electrolyzed by an ordinary asbestos diaphragm type diaphragm process. Immediately after renewal of the asbestos diaphragm, the current efficiency was 95% and the electrolytic voltage was 3.5 V. Even after about one year had passed, both the current efficiency and the electrolytic voltage were stable and the asbestos diaphragm needed not be renewed. The catholyte in which the sodium hydroxide concentration was 10% and the sodium chloride concentration was 15% was supplied to the crystallizer (triple effect evaporator) and the resulting slurry was subjected to centrifugal separation to obtain a product 37, as a mother liquor, in which the sodium hydroxide concentration was 50%, the sodium chloride concentration was 1% and the sodium sulfate concentration was about 1,000 ppm. The crystallized salt was washed with water. Simultaneously with the washing of the crystallized salt, the sodium sulfate was dissolved out and then withdrawn out of the system through a line 35.

For comparison, without a cation exchange membrane process being combined, the saline solution 6 which had been subjected to the primary purification at 4 was introduced directly to the salt-dissolving vessel 22, and water was added to dissolve the crystallized salt from the crystallizer 34. While supplying the obtained saline solution 24, electrolysis was conducted. Immediately after renewal of the asbestos diaphragm, the current efficiency was 94% and the electrolytic voltage was 3.5 V. After about one year, the current efficiency and the electrolytic voltage became about 90% and 3.6 V, respectively, thus necessitating renewal of the asbestos diaphragm. The product at that time had a sodium hydroxide concentration of 50%, a sodium chloride concentration of 1% and, a sodium sulfate concentration of about 1,000 ppm. There was not observed a significant difference in quality of product between the diaphragm process alone and the process of the present invention.

EXAMPLE 2

Using the same system and cation exchange membrane as used in Example 1, electrolysis was conducted while adjusting the amount of hydrochloric acid to be added through the line 9 so that the pH value of the weak saline solution 20 became 3.5. Other conditions of electrolysis were the same as in Example 1. Substantially the same results as in Example 1 were obtained except that the sodium chlorate concentration in the weak saline solution was about 100 ppm.

EXAMPLE 3

Using the same system and cation exchange membrane as used in Example 1, electrolysis was conducted without hydrochloric acid being added through the line 9. Other conditions of electrolysis were the same as in Example 1. The pH value of the weak saline solution was 4.0. The sodium chlorate concentration in the weak saline solution was about 420 ppm.

EXAMPLES 4 AND 5

The same system as used in Example 1 was used, but, as the cation exchange membrane, a membrane having a perfluorosulfonamide group and a membrane having a perfluorosulfonic acid group were used in Example 4 and Example 5, respectively. Electrolyses were conducted without hydrochloric acid being added through the line 9. The perfluorosulfonamide type membrane had a current efficiency of 90%, while the perfluorosulfonic acid type membrane had a current efficiency of 78%. Other conditions of electrolysis were the same as in Example 1. In the case of the perfluorosulfonamide type membrane in Example 4, the pH value of and the sodium chlorate concentration in the weak saline solution were 4.1 and 1,300 ppm, respectively. In the case of the perfluorosulfonic acid type membrane in Example 5, the pH value of and the sodium chlorate concentration in the weak saline solution were 4.4 and 4,800 ppm, respectively.

What is claimed is:

1. A process for the electrolysis of an aqueous sodium chloride solution comprising, in combination, a diaphragm process in which sodium chloride contained in the catholyte is crystallization-separated by means of a crystallizer used in the diaphragm process and a cation exchange membrane process in which a weak saline solution is taken out of an anode chamber of an electrolytic cell for the cation exchange membrane process, characterized in that the sodium chloride obtained from said crystallizer is dissolved in the weak saline solution taken out of said anode chamber and the resulting saline solution is supplied into an anode chamber of an electrolytic cell for the diaphragm process.

2. A process according to claim 1, wherein the cation exchange membrane of the cation exchange membrane process has a current efficiency of 90% or more.

3. A process according to claim 1, wherein the cation exchange membrane of the cation exchange membrane process is a membrane having a perfluorocarboxylic acid group.

4. A process according to any of claims 1 to 3, which further comprises adding an acid to the weak saline solution to adjust the pH value of said weak saline solution to not more than 3.5.

5. A process according to any of claims 1 to 3, wherein said anode chamber of the electrolytic cell for the cation exchange membrane process is supplied with a saline solution obtained by dissolving rock salt in water and/or the weak saline solution from the cation exchange membrane process.

6. A process according to any of claims 1 to 3, wherein said anode chamber of the electrolytic cell for the cation exchange membrane process is supplied with a saline solution which has been purified by means of a chelating ion exchange resin.

* * * * *